United States Patent [19]

Nagashima

[11] Patent Number: 4,765,933

[45] Date of Patent: Aug. 23, 1988

[54] CARBURETOR

[75] Inventor: Akira Nagashima, Kawasaki, Japan

[73] Assignee: Kioritz Corporation, Tokyo, Japan

[21] Appl. No.: 74,043

[22] Filed: Jul. 16, 1987

[30] Foreign Application Priority Data

Jul. 24, 1986 [JP] Japan ..... 61-172767

[51] Int. Cl.[4] ..... F02M 17/04

[52] U.S. Cl. ..... 261/44.6; 261/53; 261/62; 261/DIG. 68

[58] Field of Search ..... 261/44.6, 53, 62, 65, 261/64.6, DIG. 68

[56] References Cited

U.S. PATENT DOCUMENTS

| | | | |
|---|---|---|---|
| 1,547,296 | 7/1925 | Bullard | 261/44.6 |
| 1,568,410 | 1/1926 | Minter | 261/65 |
| 1,780,522 | 11/1930 | Hammer et al. | 261/62 |
| 2,035,191 | 3/1936 | Reynolds | 261/65 |
| 2,097,409 | 10/1937 | Wertz | 261/65 |
| 2,877,003 | 3/1959 | Goodridge et al. | 261/62 |
| 3,298,677 | 1/1967 | Anderson | 261/62 |
| 4,530,805 | 7/1985 | Abbey | 261/53 |

FOREIGN PATENT DOCUMENTS

| | | | |
|---|---|---|---|
| 283145 | 1/1928 | Fed. Rep. of Germany | 261/62 |

*Primary Examiner*—Tim Miles

*Attorney, Agent, or Firm*—Browdy and Neimark

[57] ABSTRACT

A carburetor has a butterfly valve comprising a first valve plate portion for opening and closing a portion of an intake passage adjacent to a fuel nozzle and a second valve plate portion for opening and closing a portion of the intake passage located farther from the fuel nozzle, wherein the first valve plate portion is first opened from a position of closing the intake passage up to a predetermined angle, and, when the first valve plate portion is opened by more than the predetermined angle, the second valve plate portion is opened from a position of closing the intake passage.

2 Claims, 1 Drawing Sheet

CARBURETOR

BACKGROUND OF THE INVENTION

The present invention relates to a carburetor which uses a butterfly valve as a throttle valve.

DESCRIPTION OF THE PRIOR ART

In general, conventional carburetors of this type are arranged as follows. A venturi portion is formed in an intake passage communicating with an internal combustion engine, and a fuel nozzle is formed at this portion to create an air-fuel mixture. In addition, a butterfly valve formed of a disk-shaped part is provided downstream of the venturi portion as a throttle valve, and the flow rate of the mixture which is supplied to the internal combustion engine is controlled by adjusting the opening and closing of this butterfly valve.

With the conventional carburetors of this type, unlike variable venturi-type carburetors, the venturi portion must be provided in the intake passage to ensure the stabilization and acceleration performance at times of low speed, while, during high speed, the area of the opening of the intake passage must be increased to secure an appropriate amount of air. Thus these carburetors must be able to satisfy these mutually contradictory conditions. Furthermore, the portion of the disk-shaped throttle valve which is close to the fuel nozzle and the opposite side thereof open and close simultaneously and, the venturi effect becomes weak. Consequently, acceleration-response characteristics deteriorate. Accordingly, there are drawbacks in that, in order to prevent the mixture from becoming lean during partial throttle opening, it is necessary to take auxiliary measures such as provision of an acceleration pump or pre-adjustment of the mixture to a rich level, and that it is difficult to increase the performance at full throttle opening.

SUMMARY OF THE INVENTION

Accordingly, an object of the present invention is to provide a carburetor having a simple construction and a convenient form, thereby overcoming the drawbacks of the prior art.

To this end, according to the present invention, there is provided a carburetor in which a butterfly valve comprises a first valve plate portion for opening and closing a portion of the intake passage adjacent to the fuel nozzle and a second valve plate portion for opening and closing a portion of the intake passage located farther from the fuel nozzles, wherein the first valve plate portion is first opened from a position of closing the intake passage up to a predetermined angle, and, when the first valve plate portion is opened by more than the predetermined angle, the second valve plate portion is opened from a position of closing the intake passage.

Accordingly, by virtue of the above-described arrangement of this invention, it is possible to obtain a high venturi effect positively since, when the opening of the throttle valve is small, only the first valve plate portion is opened to allow the air to flow to a portion close to the fuel nozzle in the intake passage in a concentrated manner. Hence, it is possible to obtain an appropriate air-fuel mixture. At the same time, it is possible to set the venturi portion to a minimum size and to form a large effective area for the opening of the air passage. In other words, even if the size of the venturi portion formed in the intake passage is set to a minimum, the venturi effect is obtained sufficiently by the opening and closing of the first valve plate portion. In addition, since a large intake passage area can be provided, the carburetor according to this invention displays high acceleration-response characteristics, excellent performance at partial throttle opening, and substantially improved performance at full throttle opening. Furthermore, the valve plate portions can be formed by a synthetic resin material, so that a reduction in the costs can be effected and a lightweight carburetor can be materialized.

DESCRIPTION OF THE PREFERRED EMBODIMENT

Figure 1:
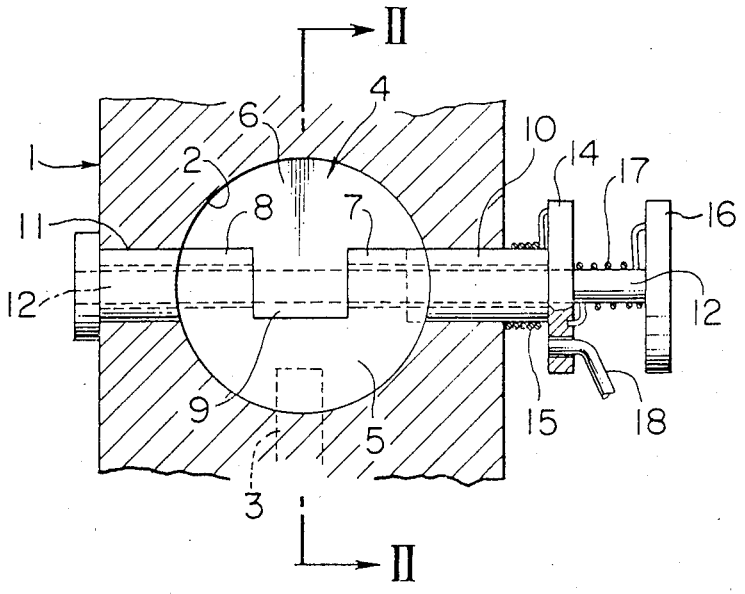
FIG. 1 is a cross-sectional view of essential portions of an embodiment of a carburetor in accordance with the present invention.

Referring now to the accompanying drawings, an embodiment of the present invention will be described.

A carburetor 1 of this embodiment has inside it an intake passage 2 with a uniform circular cross section over the entire length thereof. The carburetor 1 sucks air at an upstream end of the intake passage 2 and communicates with a mixture intake port of an internal combustion engine (not shown) at a downstream end thereof. The intake passage 2 is provided with a main fuel nozzle 3 and a sub fuel nozzle 3' at a lower passage wall portion midway thereof, and the tip portion of the main fuel nozzle 3 projects slightly into the intake passage 2 and is adapted to spray the fuel into the intake passage 2. Furthermore, a butterfly valve 4 serving as a throttle valve is disposed at a position adjacent to the sub fuel nozzle 3' which is disposed downstream of the main fuel nozzle 3 in the intake passage 2.

The butterfly valve 4 has a separately formed first semicircular valve plate portion, i.e., a lower semicircular valve plate 5, and a second semicircular valve plate portion, i.e., an upper semicircular valve plate portion 6. The lower semicircular valve plate portion 5 has large-diameter hollow valve shafts 10, 11 fixed and extending from its bosses 7, 8 transversely to the outside. Portions of the hollow valve shafts 10, 11 are rotatably supported by the main body of the carburetor 1 and are adapted to open the lower half of the intake passage 2 by rotating the lower semicircular valve plate portion 5 toward the upstream side of the intake passage 2.

The upper semicircular valve plate 6 has a small-diameter valve shaft 12 which is fixed to a boss 9 thereof and extends concentrically through holes provided in the central portions of the bosses 7, 8 of the lower semicircular valve plate portion 5 and the hollow valve shafts 10, 11. The small-diameter valve shaft 12 is supported rotatably relative to the bosses 7, 8 and the hollow valve shafts 10, 11, and is adapted to open the upper half of the intake passage 2 by rotating the upper semicircular valve plate portion 6 from a closed portion to the downstream side.

Figure 2:
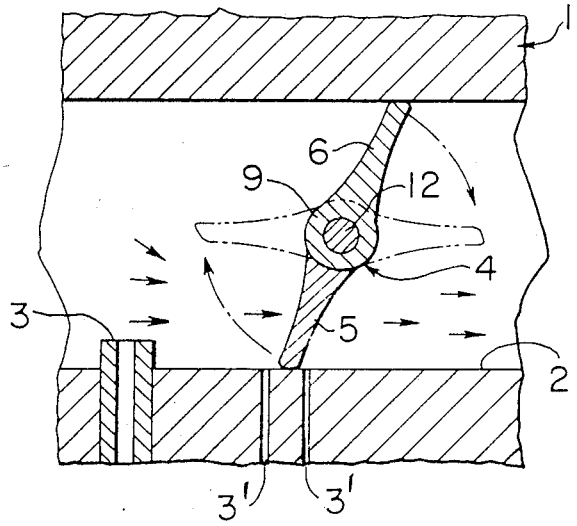
FIG. 2 is a cross-sectional view taken along the line II—II of FIG. 1.

The hollow valve shaft 10 on one side of the lower semicircular valve plate portion 5 has an inner flange portion 14 formed at an end portion thereof penetrating the passage wall of the intake passage 2 and projecting outside the carburetor 1. A valve-returning coil spring 15 is wound around the outer periphery of the hollow valve shaft portion 10 between the passage wall and the inner flange portion 14. The coil spring 15 has its opposite ends respectively retained by the carburetor 1 and the inner flange portion 14, and its spring force constantly urges the lower semicircular valve plate portion 5 in such a manner as to press the same toward its closing position (counterclockwise as viewed in FIG. 2).

The small-diameter valve shaft 12 of the upper semicircular valve plate portion 6 projects further to the outside than the inner flange portion 14 of the hollow valve shaft 10 of the lower semicircular valve plate portion 5, and an outer flange portion 16 is formed at an outer end thereof. A wound coil spring 17 is wound around the outer peripheral portion of a portion of the small-diameter valve shaft 12 projecting from the inner flange portion 14. The wound coil spring 17 is at its opposite ends coupled with the inner flange portion 14 of the hollow valve shaft 10 and the outer flange portion 16 of the small-diameter valve 12, and, at the same time, constantly urges the upper semicircular valve plate portion 6 in such a manner as to press the same toward a closing position thereof (counterclockwise as viewed in FIG. 2) by means of a separate spring (not shown).

The separate spring urges the flange portion 16 in such a manner as to press the same toward a closing position of the valve plate 6 because when the engine is started the lower semicircular valve plate 5 first rotates in the opening direction (clockwise as view in FIG. 2) from the closed position up to a relatively small predetermined angle without rotating the upper semicircular valve plate 6. But when the lower semicircular valve plate 5 rotates further than that, the upper semicircular valve plate 6 is rotated together with the lower semicircular valve 5, the spring 17 overcoming the not shown spring. Furthermore, when the lower semicircular valve plate portion 5 is in the closed position, the coil spring 17 is loosely wound around the outer peripheral surface of the small-diameter valve shaft 12. At the same time, when only the lower semicircular valve plate portion 5 first rotates in the opening direction (clockwise as viewed in FIG. 2) from the closed position up to a relatively small predetermined angle, the coil spring 17 shrinks and is brought into close contact with the outer peripheral surface of the small-diameter valve shaft 12. When the lower semicircular valve plate portion 5 rotates further than that, the upper semicircular valve plate portion 6 is rotated by spring 17 together with the lower semicircular valve plate portion 5 so as to open the entire intake passage 2.

It should be noted that, when the opening reaches a level greater than the aforementioned predetermined angle, it is more preferable to dispose a spring or the like, as required, in such a manner that the upper and lower valve plate portions 5, 6 are aligned and function as one throttle valve.

In addition, one end of a connecting rod 18 is fixed to the inner flange portion 14 of the hollow valve shaft 10 of the lower semicircular valve plate portion 5, and the other end of the connecting rod is secured to an operating lever (not shown). The connecting rod 18 rotates the inner flange portion 14 by the operation of the operating lever so as to rotate the lower semicircular valve plate portion 5 between the closed position and the fully opened position, thereby operating in such a manner as to control the opening as one throttle valve.

Starting an engine with the carburetor according to the present invention involves the same methods used in a conventional float feed carburetor. When starting a cold engine, place the shutter blade in the closed position and the throttle shutter in a cracked or open position. As the engine is cranked, engine suction will be transmitted to the diaphragm fuel chamber through both primary and secondary idle discharge ports as well as the main fuel discharge port, creating a low pressure area on the fuel side of the main diaphragm. Atmospheric air pressure on the opposite side will force the main diaphragm upward causing the diaphragm button to depress the inlet control lever, overcoming inlet tension spring pressure, permitting fuel to enter through the inlet seal, then into the fuel chamber side of main diaphragm, up through the idle and high speed fuel supply orifices and channels and out the discharge ports to the engine.

When the engine is idling, the throttle shutter is partially cracked. Engine suction is transmitted through the primary idle fuel discharge port to the fuel chamber side of the main diaphragm via the idle fuel supply channel. Again, the main diaphragm is forced upward by atmospheric pressure, depressing the inlet control lever overcoming inlet tension spring pressure and permitting fuel to enter through the inlet seal, and filling the fuel chamber. Fuel is then drawn up through the idle mixture screw orifice and delivered to the engine through the primary idle discharge port.

Fuel is delivered into and through the carburetor in the same manner as when the engine is idling. However, as the throttle opens and engine speed increases, more fuel is supplied to the engine by valving in the secondary idle discharge port located immediately behind the throttle shutter.

As the throttle shutter continues to open and engine speed increases, the velocity of air through the venturi creates a low pressure area at the venturi throat and diminishes the suction on the engine side of the throttle shutter. When the pressure at the venturi throat is less than that existing within the main diaphragm fuel chamber, fuel is drawn up through the high speed mixture orifice and out the main fuel discharge port into the air stream entering the engine intake.

As the throttle shutter progressively opens from intermediate position to full open position, the air velocity through the venturi increases and fuel is metered up through the high speed mixture orifice and the main fuel discharge port in accordance with the power requirements of the engine. The action of the main diaphragm is the same as previously described with suction required to operate the diaphragm being transmitted through the main fuel discharge port.

What is claimed is:

1. A carburetor having an intake passage for supplying air to an internal combustion engine, a fuel nozzle disposed at one side portion of said intake passage and adapted to spray fuel into said intake passage, and a butterfly valve disposed in said intake passage downstream of said fuel nozzle, said butterfly valve comprising a first valve plate portion for opening and closing a portion of said intake passage adjacent to said fuel nozzle and a second valve plate portion for opening and closing a portion of said intake passage located farther from said fuel nozzle, means to first open said first valve plate portion from a position of closing said intake passage up to a predetermined angle, and, when said first valve plate portion is opened by more than said predetermined angle, to open said second valve plate portion from a position of closing said intake passage, a small diameter valve shaft and a hollow valve shaft for rotating said first and second valve plate portions, said valve shafts extending concentrically and having springs that constantly urge said valve plate portions in the direction of closing the same.

2. A carburetor according to claim 1, wherein there is provided a wound coil spring which is loosely wound around the outer periphery of said small-diameter valve shaft when said first valve plate portion is in closed position, and which is brought into close contact with the outer peripheral surface of said small-diameter valve shaft when said first valve plate portion is opened by a predetermined angle in the opening direction.

* * * * *